US008777043B2

(12) United States Patent
Furlong

(10) Patent No.: US 8,777,043 B2
(45) Date of Patent: Jul. 15, 2014

(54) STORAGE CONTAINER AND CONTAINER SYSTEM

(75) Inventor: Brian D. Furlong, Davidson, NC (US)

(73) Assignee: Rubbermaid Incorporated, Huntersville, NC (US)

( * ) Notice: Subject to any disclaimer, the term of this patent is extended or adjusted under 35 U.S.C. 154(b) by 1503 days.

(21) Appl. No.: 11/673,378

(22) Filed: Feb. 9, 2007

(65) Prior Publication Data

US 2007/0187277 A1 Aug. 16, 2007

Related U.S. Application Data

(60) Provisional application No. 60/771,658, filed on Feb. 9, 2006.

(51) Int. Cl.
*B65D 1/06* (2006.01)
*B65D 43/03* (2006.01)
*B65D 21/00* (2006.01)

(52) U.S. Cl.
USPC ..... 220/514; 220/781; 206/508

(58) Field of Classification Search
USPC ..... 220/514, 781, 802, 350, 796, 641, 630, 220/23.86, 380; 206/508, 581, 509, 908, 206/514, 515, 516, 519; 215/323
See application file for complete search history.

(56) References Cited

U.S. PATENT DOCUMENTS 2,412,325 A 12/1946 Devine et al.
3,137,409 A 6/1964 Davis
3,722,731 A 3/1973 McCormick et al.

(Continued)

FOREIGN PATENT DOCUMENTS

WO WO03/062070 7/2003

OTHER PUBLICATIONS

International Search Report and Written Opinion issued in corresponding International application No. PCT/US2007/061925 mailed Jul. 13, 2007.

(Continued)

*Primary Examiner* — Bryon Gehman
*Assistant Examiner* — Shawn M Braden
(74) *Attorney, Agent, or Firm* — Lempia Summerfield Katz LLC

(57) ABSTRACT

A storage container system has a plurality of container bases and a plurality of lids for the bases. Each of the bases has a bottom, a continuous side wall extending up from the bottom and terminating at a top edge, an interior storage space within the side wall above the bottom, and an open top bounded by the top edge. Each of the lids has a main panel section, a perimeter skirt assembly around the main panel section, a top side, and a bottom side. Each of the plurality of lids is configured to close off the open top of any one of the plurality of container bases by connecting the perimeter skirt assembly to the side wall near the open top. A first snap structure is provided on each of the plurality of lids. Each first snap structure has one component configured to connect to a mating lid component of the first snap structure on any other one of the plurality of lids to connect any two of the plurality of lids together. A second snap structure different from the first snap structure is also provided on each of the plurality of lids. The second snap structure is configured to connect to a mating base component on the bottom of the base to connect any one of the plurality of lids to any one of the plurality of container bases.

28 Claims, 9 Drawing Sheets

(56) References Cited

U.S. PATENT DOCUMENTS

| | | | | | |
|---|---|---|---|---|---|
| 3,730,385 | A | | 5/1973 | Rost | |
| 3,784,052 | A | | 1/1974 | Edwards | |
| 3,954,178 | A | * | 5/1976 | Mason, Jr. | 206/508 |
| 3,989,142 | A | | 11/1976 | Gwilliam, Jr. et al. | |
| 4,082,184 | A | | 4/1978 | Hammer | |
| 4,127,189 | A | | 11/1978 | Schumrak et al. | |
| 4,183,446 | A | | 1/1980 | Davis | |
| 4,204,609 | A | | 5/1980 | Kuhn | |
| 4,407,426 | A | | 10/1983 | McLaren et al. | |
| 4,446,969 | A | | 5/1984 | Tyler | |
| D277,632 | S | | 2/1985 | Staufenberg | |
| 4,685,582 | A | | 8/1987 | Pulciani et al. | |
| 4,700,842 | A | | 10/1987 | Grusin | |
| 4,703,857 | A | * | 11/1987 | Jahnen et al. | 206/503 |
| 4,804,092 | A | | 2/1989 | Jones | |
| 4,951,832 | A | | 8/1990 | Tenney et al. | |
| 5,184,745 | A | | 2/1993 | Havens et al. | |
| 5,220,999 | A | | 6/1993 | Goulette | |
| 5,312,011 | A | | 5/1994 | Fischer | |
| 5,409,126 | A | | 4/1995 | Demars | |
| 5,409,128 | A | | 4/1995 | Mitchell | |
| 5,586,656 | A | | 12/1996 | Abrums | |
| 5,692,617 | A | | 12/1997 | Adams | |
| 5,769,229 | A | | 6/1998 | Andress et al. | |
| 5,775,483 | A | | 7/1998 | Lown et al. | |
| 5,799,792 | A | | 9/1998 | Abrums | |
| D466,364 | S | | 12/2002 | Demore | |
| 6,571,981 | B2 | | 6/2003 | Rohlfs | |
| 6,685,049 | B1 | | 2/2004 | Paladino | |
| 6,708,824 | B2 | | 3/2004 | Sahm, III | |
| 6,729,472 | B2 | | 5/2004 | Stucke et al. | |
| 6,796,430 | B2 | | 9/2004 | Mercier et al. | |
| 6,796,460 | B2 | * | 9/2004 | Ichikawa et al. | 222/105 |
| 6,886,694 | B2 | * | 5/2005 | McNeeley et al. | 206/505 |
| 2005/0109654 | A1 | | 5/2005 | Kolar et al. | |
| 2005/0194390 | A1 | * | 9/2005 | Savicki et al. | 220/781 |
| 2006/0186014 | A1 | * | 8/2006 | Ramanujam et al. | 206/508 |

OTHER PUBLICATIONS

Product literature for Trouve food storage containers from www.savethelids.com, May 3, 2007.

Product literature for Snap Saver food storage containers from www.snap-saver.com, May 3, 2007.

* cited by examiner 50
64
66
70
68
58
88
52
86
54
74
32
94
82
96
84
95
52
86
54
70
88
58
66
50
68
56
64
72

32
68
50
56
66
54
97
82
95
84
96
44
52
86
84
95
96
82
97
94
72
56
48

50
68
72
66
82
74
96
86
97
46
97
96
86
74
32
48

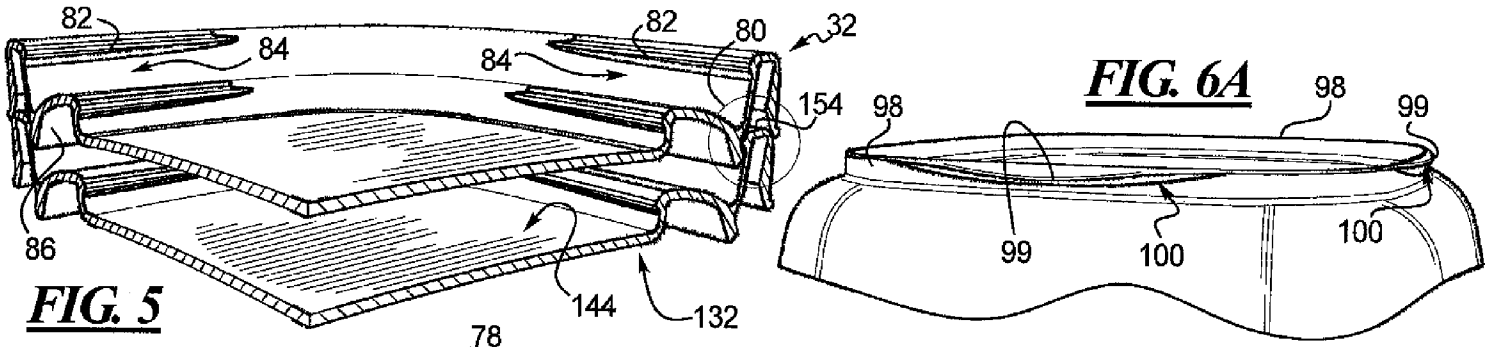
FIG. 5
FIG. 6A
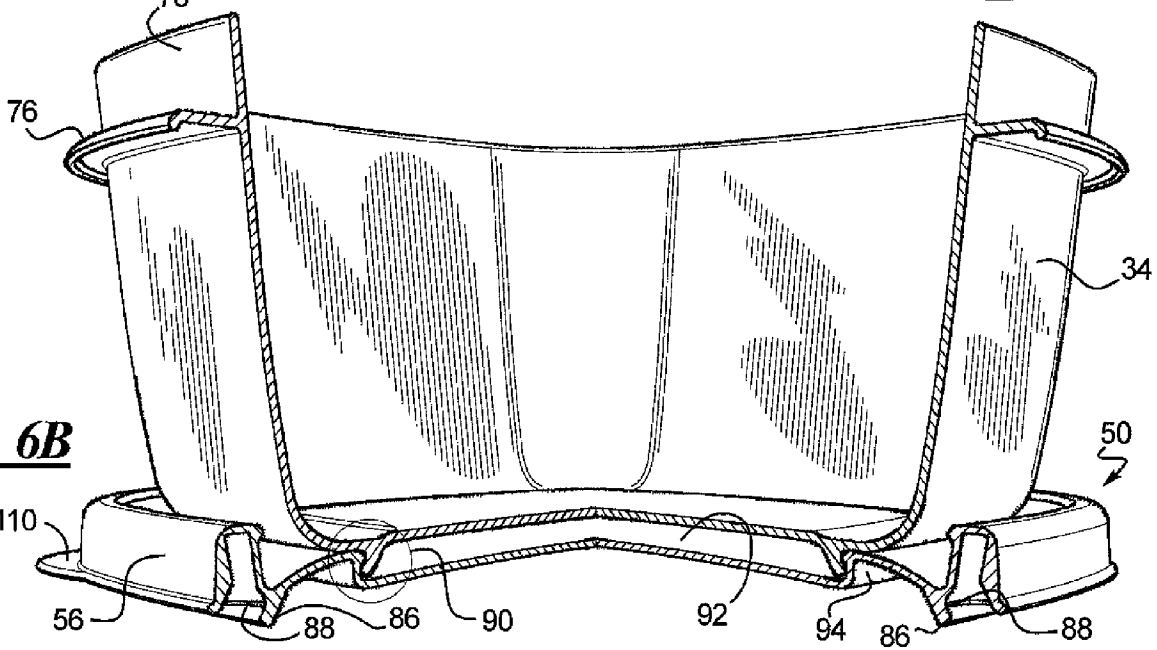
FIG. 6B

STORAGE CONTAINER AND CONTAINER SYSTEM

RELATED APPLICATION DATA

This patent is related to and claims priority benefit of U.S. Provisional Application Ser. No. 60/771,658, which was entitled "Storage Container System," and which was filed on Feb. 9, 2006.

BACKGROUND OF THE INVENTION

1. Field of the Disclosure

The present disclosure is generally directed to storage containers, and more particularly to a storage container and container system that includes multiple containers and multiple lids with snap features so that the lids and containers may be snapped together in various configurations either during use or during non-use.

2. Description of Related Art

Conventional storage containers, such as for storing food items, are commonly formed of generally or substantially rigid plastic configurations. Plastic containers of this type generally have a base and a lid that attaches to the base. The base typically has a bottom and a side wall that together define an interior storage space in the container. The lid can be attached to the base to cover the open top and to seal the storage space.

Such plastic containers are generally available in a variety of sizes to store or transport different volumes of food items. Each size container typically includes a corresponding lid sized to fit its associated container. A user will typically store empty containers in a kitchen cabinet or pantry area when not in use. When not being used, the lids often become separated from their associated container bases. Users have expressed frustration over lost or misplaced lids and the difficulty in finding the correct lid for a selected container.

Some known container systems include lids that attach to the bottom of their respective container bases to help manage the containers and lids by keeping the lids and their corresponding containers together. Such lids, when attached to the base bottoms, often hinder space efficient stacking and storage of multiple containers. However, the user still needs to find the specific lid for the corresponding container base when the lids and container bases become separated, such as during cleaning. This is because containers of one storage capacity typically have lids specifically sized for only those containers, and containers of another storage capacity typically have lids of a different size.

During normal use, a container base is typically filled with food items and covered with the lid. Users sometimes stack full containers for refrigerator storage or for transport to a location outside the home. However, the stacked containers tend to be unstable and can slide off of each other and become separated. This makes it difficult to keep the containers organized in refrigerated storage and difficult to transport. A known storage container system disclosed in U.S. Pat. No. 6,886,694, commonly assigned to the assignee of the present patent, employs a lid and base configuration whereby a base can rest on the lid of another container and register with the lid. However, the lid of the underlying base does not connect or attach to the base of the overlying container.

One example of a prior art container system is shown and described in U.S. Pat. No. 5,692,617 and includes a plurality of containers and a plurality of lids that can attach to one another in a variety of ways. Each lid includes opposed male and female fasteners centrally located with one fastener on each side of the lid. The lids are connectable as a stack by interconnecting adjacent male and female fasteners of adjacent lids. Additionally, a stack of lids can be attached to a stack of nested containers. Each container includes a female fastener, identical to the female fastener on the lids, located on its bottom surface. The stacked lids can be attached to the nested containers by snapping an exposed one of the aforementioned male lid fasteners to an exposed female fastener of the bottom of an exposed container. When full and in use, these containers could be stacked upon one another, but the stack would not be stable because of the small size and configuration of the male and female connectors on the bases and lids.

Another prior art container system is shown and described in U.S. Pat. No. 4,951,832 and includes a plurality of containers and lids, Each lid is sized to fit only its associated container. The inner surface of each lid is contoured either to snap-fit over the open top or onto the bottom of its respective container. The different sized containers can be stacked in a nested configuration, one inside the other, while the lids remain attached to the bottom of the corresponding container. The lids can not be stacked together and the containers when full and in use can not be stacked on top of one another in a stable arrangement.

Yet another prior art container system is shown and described in U.S. Pat. No. 5,409,128 and includes stackable containers with lids. The containers have a first threaded segment on an outer surface near the open top adapted to engage with a first threaded segment on an inner surface of the lids so that the lids close off the open top of the container. Additionally, each lid includes a stepped portion of its top. The stepped portion includes a second threaded segment sized and shaped to mate with a second threaded segment formed within a lower rim of the container so that the lids can thread to the bottom of adjacent containers when stacked. A stable stack can be created, but the lids can not attach to one another for storage and the threaded connection method can be somewhat difficult to use, particularly with full containers.

BRIEF DESCRIPTION OF THE DRAWINGS

Objects, features, and advantages of the present invention will become apparent upon reading the following description in conjunction with the drawing figures, in which:

FIG. 5 shows a top perspective view of the three quarter cut-away section of the lid in FIG. 3B and connected to a like lid in a lid-to-lid stack.

FIG. 6A shows a bottom view of the base of the container shown in FIG. 2.

FIG. 6B shows a corner perspective view of a one quarter cut-away section of the lid and base in FIG. 2 and with the lid snapped onto the bottom of the base.

DETAILED DESCRIPTION OF THE DISCLOSURE

Figure 1:
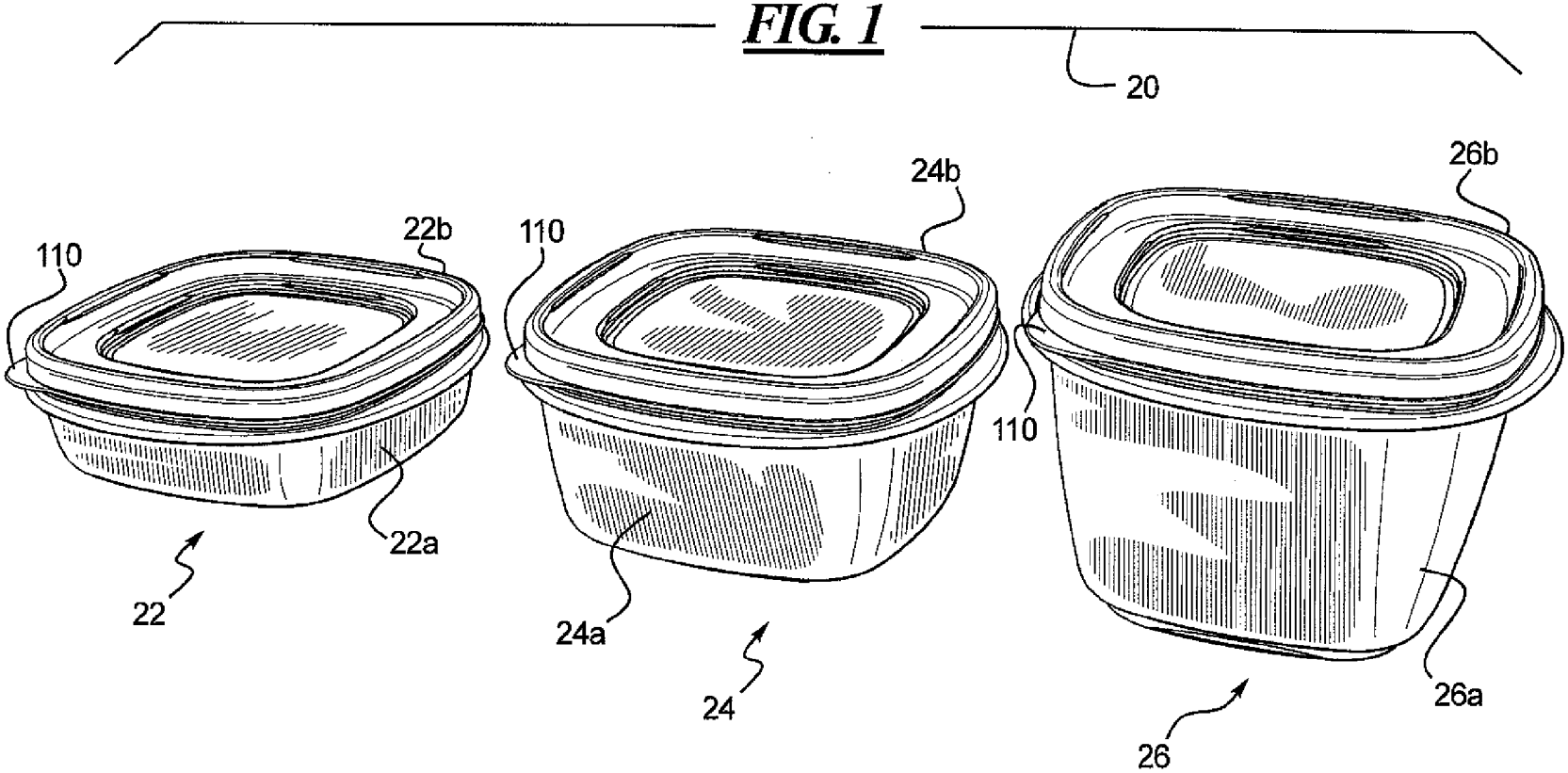
FIG. 1 shows a perspective view of a set of multiple storage containers having different storage capacities and constructed in accordance with the teachings of the present invention.

The present invention is for a storage container and a container system. The disclosed container and system solves or improves upon one or more of the above-noted and other problems with and disadvantages of currently known storage containers. The disclosed container has a base and a lid. The lid has snap structures, one for snapping the lid to other like lids and another to snap the lid to the bottom of its base. The system includes multiple container bases and lids. The container bases can all have the same capacity, different capacities, or combinations and multiples of varying same and different capacities.

In one example, multiple container bases can be provided having varying storage space capacities with open tops that are identical in size and shape regardless of interior capacity. The lids can be identical one-size-fits-all or universal lids so that any lid can be used with any container base regardless of base storage capacity. In another example, the system can be provided having multiple different sized container bases, some of which have different sized open tops. In such an example, at least the container bases of the same open top size and shape can have a lid that is sized to fit the associated container bases. In each example, the bases and/or lids can be snapped together in various configurations either during use to store food items or during non-use. The disclosed container bases and lids can be formed of either a generally or substantially rigid plastic material and retain the same size and shape whether in use or not.

The lids of the disclosed system include a first snap feature that allows for a lid-to-lid snap connection. The lids also include a second snap feature that cooperates with a corresponding feature on the container bases to provide a lid-to-base bottom snap connection. The lids and container bases can be snapped together in a variety of configurations. Each lid also has a seal feature so as to fit over the top of the container base and seal the storage space of the base. Multiple lids can be snapped together to keep the lids together when not in use. In another example, a single lid may be snapped onto the bottom of an associated container base to keep the lid and container base together. In yet another example, multiple lids may be snapped together to form a stack that is then snapped onto the bottom of either a single container base or multiple container bases nested and stacked together. In still another example, a container sealed with a lid can be snapped onto a lid of another container base sealed with a lid. In another example, the disclosed container bases can also be nested together regardless of base volume.

Currently known plastic storage containers are typically stored in a kitchen cabinet or pantry area when not in use. However, many homes are not equipped with adequate storage space, especially for kitchen and food related storage items. Most users have a variety of container sizes with associated lids that are sized and shaped to fit a particular container to seal the container when in use. Currently known plastic storage containers typically take up a large amount of cabinet storage space since the container bases and lids are fairly rigid. A typical user may store the container bases and lids separately in the cabinet or pantry. Users often complain that the containers and lids become separated in the cabinet or pantry, requiring time and effort to find the lid that matches the desired container. Even when a base and lid organizer or rack is employed, it can still be difficult for a user to find a desired base and the appropriate lid for that base. Some users store their containers in a lid-on condition so that the containers may be stacked and the lids readily located. However, many cabinets and pantries are not tall enough to allow more than two such assembled containers to be stacked, requiring the stacked containers to be stored in a side-by-side condition. This method takes up a lot of shelf space in the cabinet or pantry and leaves significant cabinet or pantry storage space unused.

During use, plastic food storage containers hold food items and either are stored in a refrigerator or are transported to venues outside the home, such as, for example, to picnics, parties, pot luck dinners, or church socials. Users often employ more than one container to store or transport different food items and may stack the various containers. Stacking the full containers in a refrigerator, for example, provides organized storage. However, the stacked containers may slide around, slide off of one another, tip and fall, or otherwise become separated from each other. This can create spills or a cluttered and unorganized refrigerator. Additionally, when in use, users typically stack and carry fall containers during transport. However, the full containers can easily slip off of one another, tip and fall, and become separated. This makes it difficult to carry and load the fall containers from the home into a vehicle and to carry the containers from the vehicle to the destination. Additionally, it can be difficult to prevent the containers from becoming separated and sliding around inside the vehicle during transport. This not only can make transporting the full containers difficult but also can create the possibility of food spillage.

The present invention overcomes these and other problems with prior known containers by providing a storage container system that includes one or more container bases and associated lids that have unique snap features. The unique snap features are configured so that the container bases and lids can be stacked to form a small footprint and take up as little space as possible either in use while storing food items in a refrigerator or in non-use while being stored away in a cabinet or pantry. Additionally, the snap features allow the container bases and lids to be stacked together in a locked, stable, or secure manner to prevent separation to facilitate storage or transport during use.

Turning now to the drawings, FIG. 1 shows one example of the container system constructed in accordance with the teachings of the present invention. The disclosed system can include a set 20 of multiple containers 22, 24, and 26. Although the set 20 is shown to include three containers, the invention is not limited to only three containers and may include fewer or more than three containers in the set. Also, the system can include multiple containers of the same size or can include containers of different storage capacity but utilizing a common lid size as shown in FIG. 1. In another example, the system can be provided with some containers of the same size, some of different storage capacity but with common lids, and some of different size and shape.

Each container 22, 24, and 26 of the disclosed example includes a container base and a lid. For example, the container 22 includes a base 22*a* and a lid 22*b*. Likewise, the container 24 includes a base 24*a* and a lid 24*b* and the container 26 includes a base 26*a* and 26*b*. The container bases in the set 20 in this example have various capacities to store different amounts of food items. For example, using the standard measuring cup capacity, the respective container base capacities can be of a three cup (container 22), five cup (container 24), and seven cup (container 26) storage capacity. However, these capacities are given only as examples and the invention contemplates containers having other storage capacities as well. While all of the bases 22*a*, 24*a*, and 26*a* can be of different interior capacities they are all of similar construction in this example. The lids 22*b*, 24*b*, and 26*b* are formed identically and are one-size-fits-all or universal so that any lid can fit onto any base.

The bases and lids of the set 20 are shown to be of a substantially square-like or generally rectangular cylinder shape. However, other shapes and configurations of the bases and lids, such as round or circular, are contemplated and are intended to fall within the scope of the invention. The invention is not to be limited to a specific container base and lid perimeter shape or overall contour.

Figure 2:
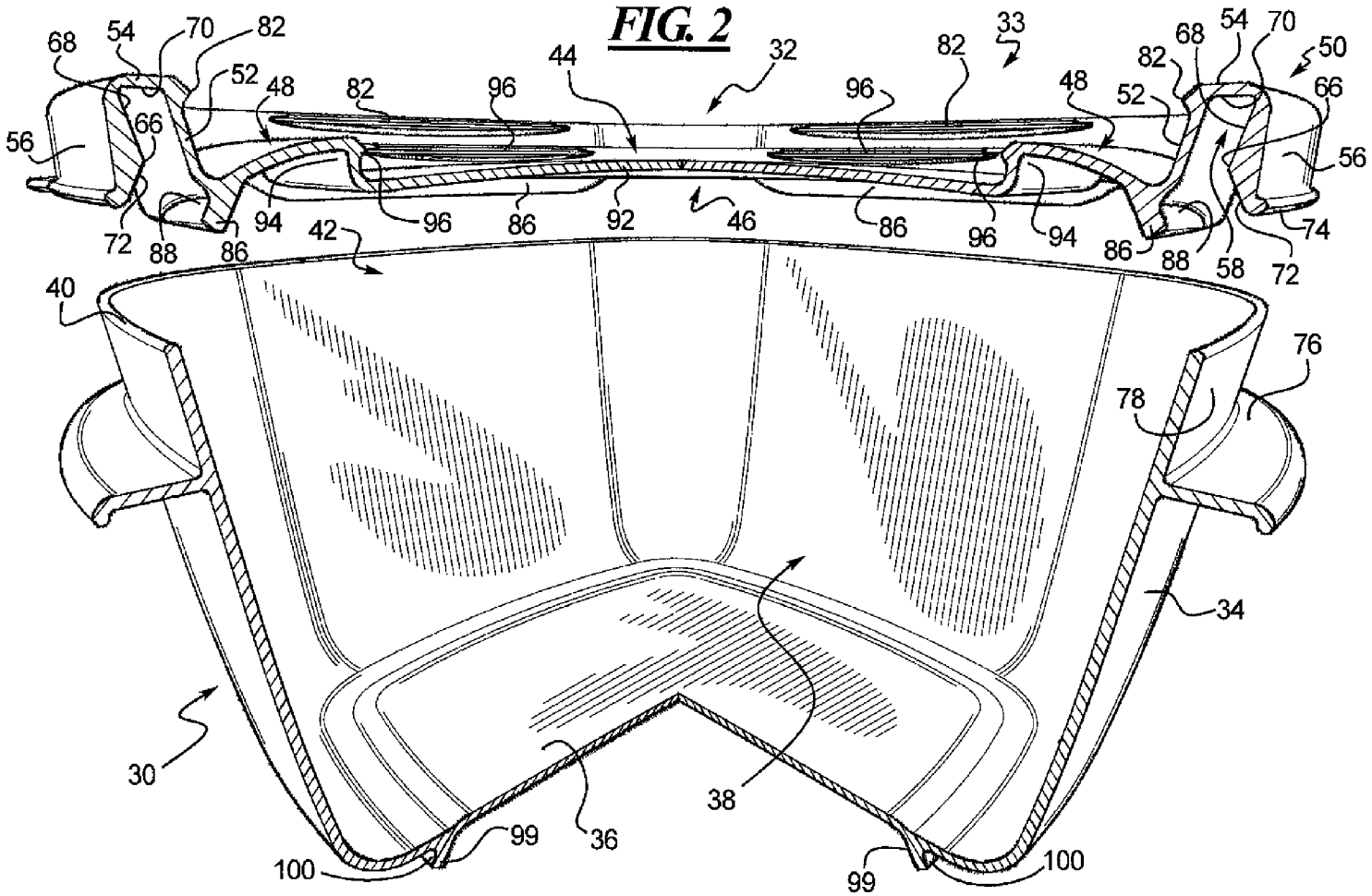
FIG. 2 shows an exploded view of a one quarter vertical cut-away section of a base and a lid that are representative of any one of the storage containers from the set shown in FIG. 1.
Figures 3A, 3B, 3C:
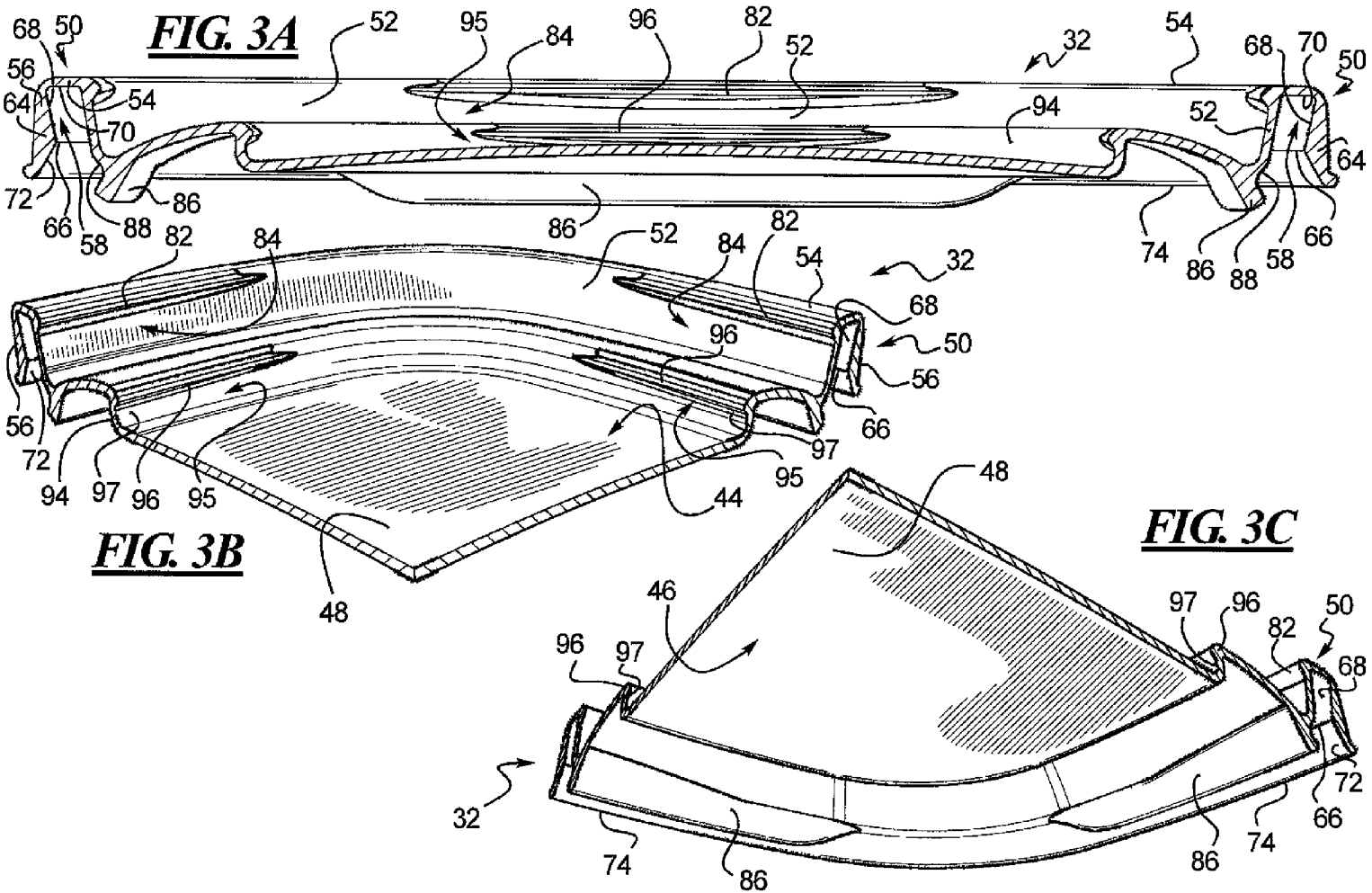
FIG. 3A shows a center vertical cross section of the lid in FIG. 2.
FIG. 3B shows a top perspective view of a three quarter cut-away section of a corner of the lid in FIG. 2.
FIG. 3C shows a bottom view of the three quarter section of the lid in FIG. 3B.

Referring now to FIG. 2, structural details of a representative base 30 and lid 32 are shown. The representative lid and base include features that can equate to the features of any of the aforementioned containers 22, 24, or 26. The base 30 and the lid 32 can be used together as a representative container 33. The base 30 has a continuous side wall 34 and a bottom 36 that defines an interior storage space 38. In this example, the side wall 34 and the bottom 36 form a substantially square cylinder shape, but with rounded corners and a slight outwardly tapered side wall as are known in the art. As noted above, other shapes and configurations are contemplated and fall within the scope of the invention. The specific dimensions of the side wall 34 and the bottom 36 may vary yet remain within the scope of the invention as well. The side wall 34 extends upwardly and generally outwardly from a perimeter of the bottom 36 and terminates at a top edge 40 that defines an open top 42. The open top 42 of the base 30 in this example can be identical in size and shape, regardless of interior volume, to other containers of the system so that all lids fit all bases.

The lid 32 is formed with features that allow it to cover and seal the open top 42 of the container base 30. As shown in FIGS. 2, 3A-3C, 4A, and 4B, the lid 32 has a top side 44, a bottom side 46, a main panel section 48 and a perimeter skirt assembly 50. The skirt assembly 50 circumvents the perimeter of the main panel section 48 and in this example has a generally inverted U-shape in cross section. As will be evident to those of ordinary skill in the art, the skirt assembly can very in configuration and construction and yet fall within the spirit and scope of the present invention. In this example, the skirt assembly 50 has an inner wall 52 that extends generally normal or perpendicularly upward from the plane of the main panel section 48. The inner wall 52 continues into a top wall 54, which in turn continues to an outer skirt wall 56 that extends generally downward from the top wall 54. The outer skirt wall 56 is spaced from inner wall 52 and forms an annular channel 58.

Figure 4A:
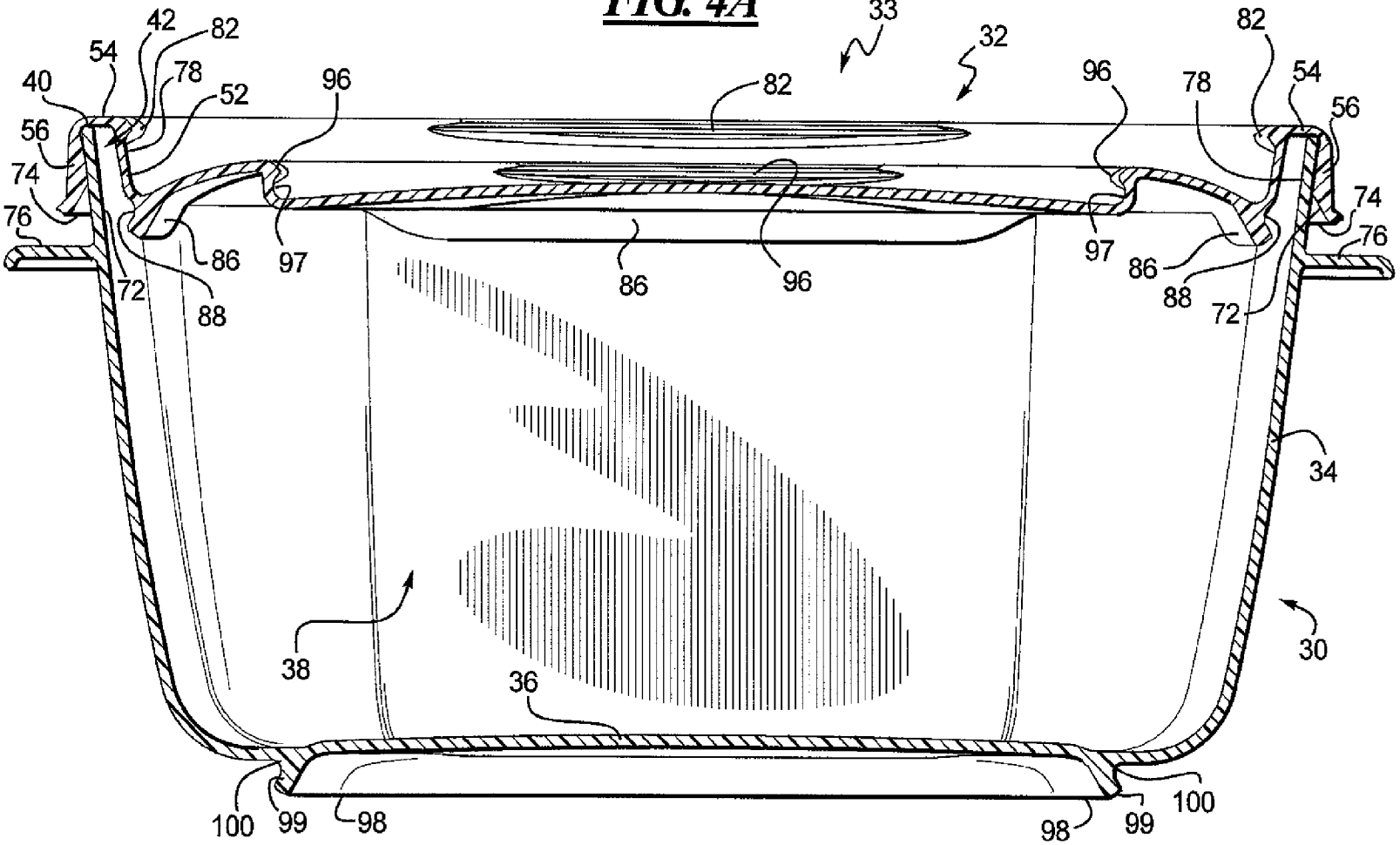
FIG. 4A shows a vertical center cross section of the lid and base in FIG. 2 and with the lid attached over the open top of the base.
Figure 4B:
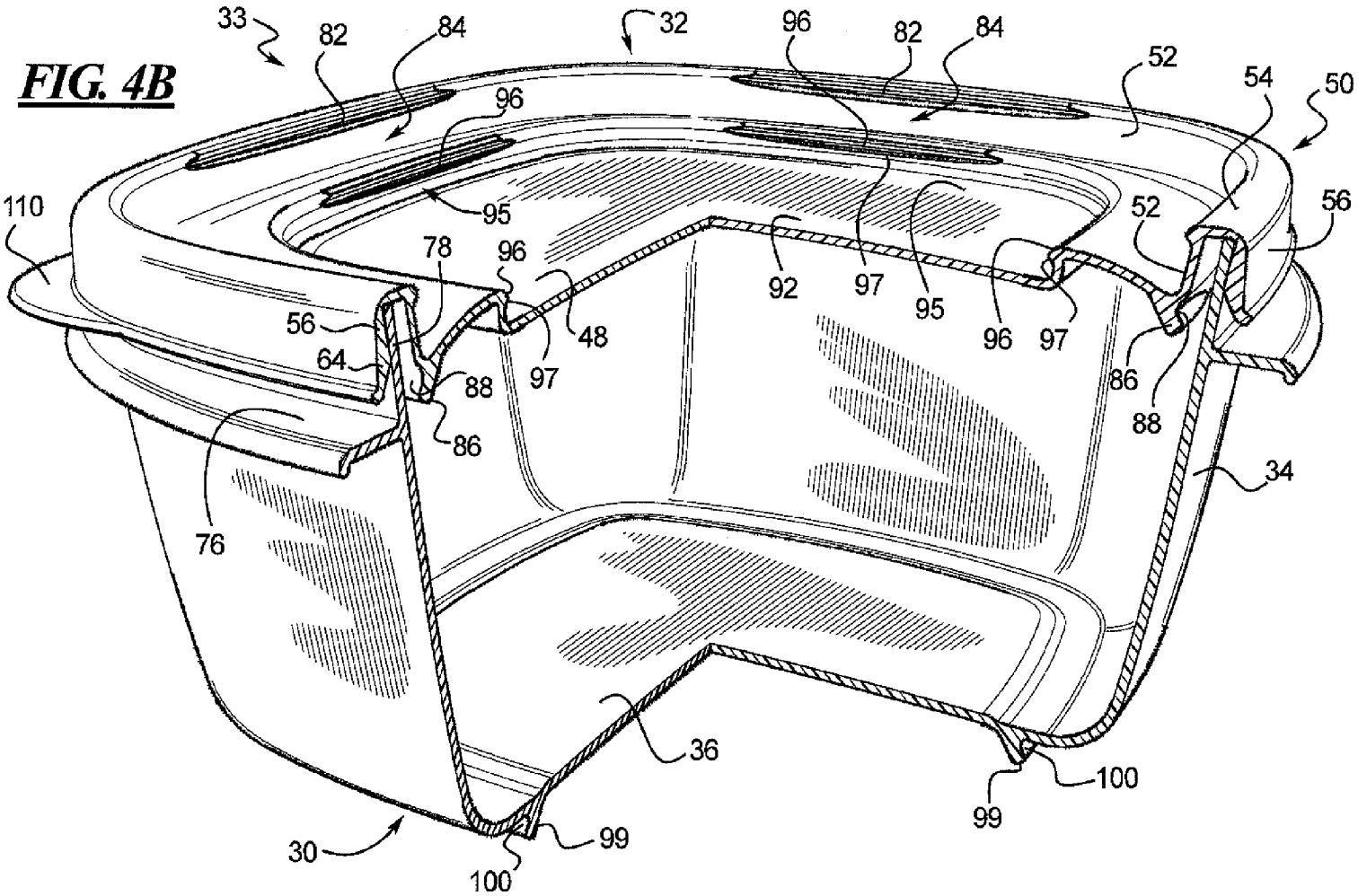
FIG. 4B shows a top perspective view of a one quarter cut-away section of the assembled container in FIG. 4A.

As shown in a combination of FIGS. 2, 4A and 4B, the lid 32 fits over the base 30 so that the top edge 40 of the side wall 34 is received within the channel 58. In this in use configuration, the lid 32 covers and closes off the open top 42 to seal the storage space 38. The top side 44 faces upward and the bottom side 46 faces downward into the interior storage space of the container 33. The shape and construction of the skirt assembly 50 can vary and yet remain within the scope of the invention. In addition, other lid-to-base seal configurations can be utilized on the storage container and container system components disclosed herein and yet fall within the spirit and scope of the invention.

In this example, the outer skirt wall 56 includes a gradually thicker portion 64 that is shaped to form an annular seal ridge 66 that extends radially inwardly around the inner surface of the outer skirt wall 56 and is coincident with the greatest thickness part of the thicker portion 64. An upper surface 68 is positioned above the ridge 66 on the inside of the outer skirt wall 56. Moving up from the ridge 66, the upper surface 68 is angled radially outwardly and meets an underside surface 70 of the top wall 54. A lower surface 72 is positioned below the ridge 66 on the inside surface of the outer skirt wall. Moving down from the ridge 66, the lower surface 72 is angled radially outwardly and meets a lower edge 74 of the outer skirt wall 56. The base 30 has an annular flange or rim 76 that extends radially outwardly from and circumferentially around the side wall 34. The rim 76 is located near the top edge 40 of the side wall 34, but spaced below the top edge. An upper portion 78 of the side wall 34 is thus defined above the rim 76 and is angled slightly radially outward. When the lid 32 is fit onto the base 30 to seal off the open top 42, the upper portion 78 of the base side wall 34 is received in the channel 58 of the lid 32. The ridge 66 of the thickened portion 64 and the upper surface 68 of the inside of the skirt wall 56 bear with some interference against the outside surface of the upper side wall portion 78. The top edge 40 of the base 30 and the underside surface 70 of the top wall 54 or the skirt assembly are drawn toward one another to bear against one another by their relative cylinder sizes and the relative surface-to-surface interference. This creates a seal at the interface between the upper surface 68 on the skirt wall and the sidewall portion 78, as well as between the top edge 40 and the underside surface 70 of the skirt assembly.

As seen in FIGS. 3A-3C and 5, the lids 30 include a first snap structure 80 to allow lid-to-lid attachment for stacking lids. FIG. 5 shows the lid 32 attached to a second lid 132 forming a lid-to-lid stack of just two lids. Any number of like lids can be connected in a stack. The first snap structure 80 can be formed in a number of alternative ways that differ from the structures shown. In one example, the parts of the first snap structure 80 can be provided having an inverse part orientation from that shown, and yet remain within the scope of the invention.

In the disclosed example, the first snap structure 80 for lid-to-lid connection includes two components that mate with one another. Both components are provided as a feature of the lid structure. As shown in FIGS. 3A-3C and 5, one component of the first snap structure 80 is a plurality of lip or beads 82 formed on the top side 44 of the lid. In this example, four beads or lips 82 are positioned spaced apart around and extending radially inward from the inside surface of the inner skirt wall 52. In this example, the inner skirt wall 52 has four generally flat sections 84 created as a result of the generally square lid configuration and a bead 82 protrudes from each wall section 84. Each of the beads or lips 82 is positioned at the upper end of the inner skirt wall 52 near the intersection with the top wall 54 of the skirt assembly 50. Thus, each bead or lip 82 creates an undercut between the bead or lip and the main panel section 48 at the base of the wall 52 on each flat 84.

The mating component of the first snap structure 80 is on the bottom side 46 of the lid 32 in this example. The disclosed mating part includes four complimentary angled protrusions or ribs 86. Each rib 86 is positioned generally at the base of the inner wall 52 where the skirt assembly meets the main panel section 48. Each rib 86 extends downward and is angled radially outward. A radially outward facing groove or recess 88 is thus formed on the outside facing surface of each rib 86 at the intersection between the rib and the underside of the lid at the base of the inner wall 52. The ribs 86 in this example are positioned beneath and aligned with the beads or lips 82 on the top side 44 of the lid 32.

As shown in FIG. 5, in order to stack two lids 32 and 132 in a lid-to-lid configuration the lips or beads 82 on the top side 144 of the lower lid 132 are forcibly and securely snapped into a corresponding one of the grooves or recesses 88 on the bottom side 46 of the upper lid 32 in the stack. The bottom edge 74 of the outer skirt wall 56 of the upper lid 32 rests against the top portion 154 of the bottom lid 132 when stacked.

In this example, each lip or bead 82 projects radially inward and each annular recess 88 faces radially outward on the representative lid 32 to receive one of the lips 88 of an adjacent lid. However, as noted above, this arrangement could be inverted and the details of the particular structures can vary from those shown. Alternative mating snap component structures can be utilized and yet fall within the spirit and scope of the present invention. For example, the lips or beads 82 can be formed having more or less than four segments and can be placed at different locations on the lid from that shown. Also, a continuous annular lip or bead can also be utilized, if desired. The same variations can be employed for the lips or beads 82 and the grooves 88 as well.

As shown in FIGS. 6A, 6B, 7, and 8, a second snap structure 90, which is different from the first snap structure 80, provides for a lid-to-base snap connection whereby a lid 32 is snapped onto the bottom 36 of a base 30. As seen most clearly in FIGS. 6A, 6B, and 8, a first component of the snap structure 90 is formed on the top side 44 of the lid 32 and a second component of the snap structure 90 is formed on the bottom 36 of the base 30. In one example, the first component of the snap structure 90 is created by a downwardly recessed region 92 in the main panel section 48 of the lid 32. The recessed region 92 is smaller than the perimeter of the main panel section 48 and thus is spaced inward from the inner wall 52 of the skirt assembly 50. A surrounding wall 94 transitions between the top surface of the recessed region 92 and the top side 44 of the main panel section 48. Similar to the first snap structure components, the surrounding wall has four generally flat sections 95 as a result of the substantially square lid configuration in this example. A plurality of protrusions 96 extend radially inward, one from each flat sections 95 of the surrounding wall 94, and define a plurality of undercuts 97, one below each protrusion. In this example, there are four protrusions and four undercuts.

The second component of the snap structure 90 is formed as a part of a foot or rib 98 that depends downward from the bottom 36 of the base 30.One or more flanges 99 in this example project radially outward from the bottom of the foot 98. Each flange 99 is positioned to coincide with the positioning of the undercuts 97 on the lid 32. The foot 98 in this example is a continuous annular rib on the base bottom 36, but can also be formed as a plurality of feet, each having one of the flanges extending therefrom. A channel 100 is formed facing radially outward between each flange 99 and the surface of the bottom 36 of the base 30. Again, the mating components of the lid-to-base snap structure 90 can also vary and yet fall within the spirit and scope of the present invention. The features as disclosed herein can also be inverted and placed on the opposite parts.

Figure 8:
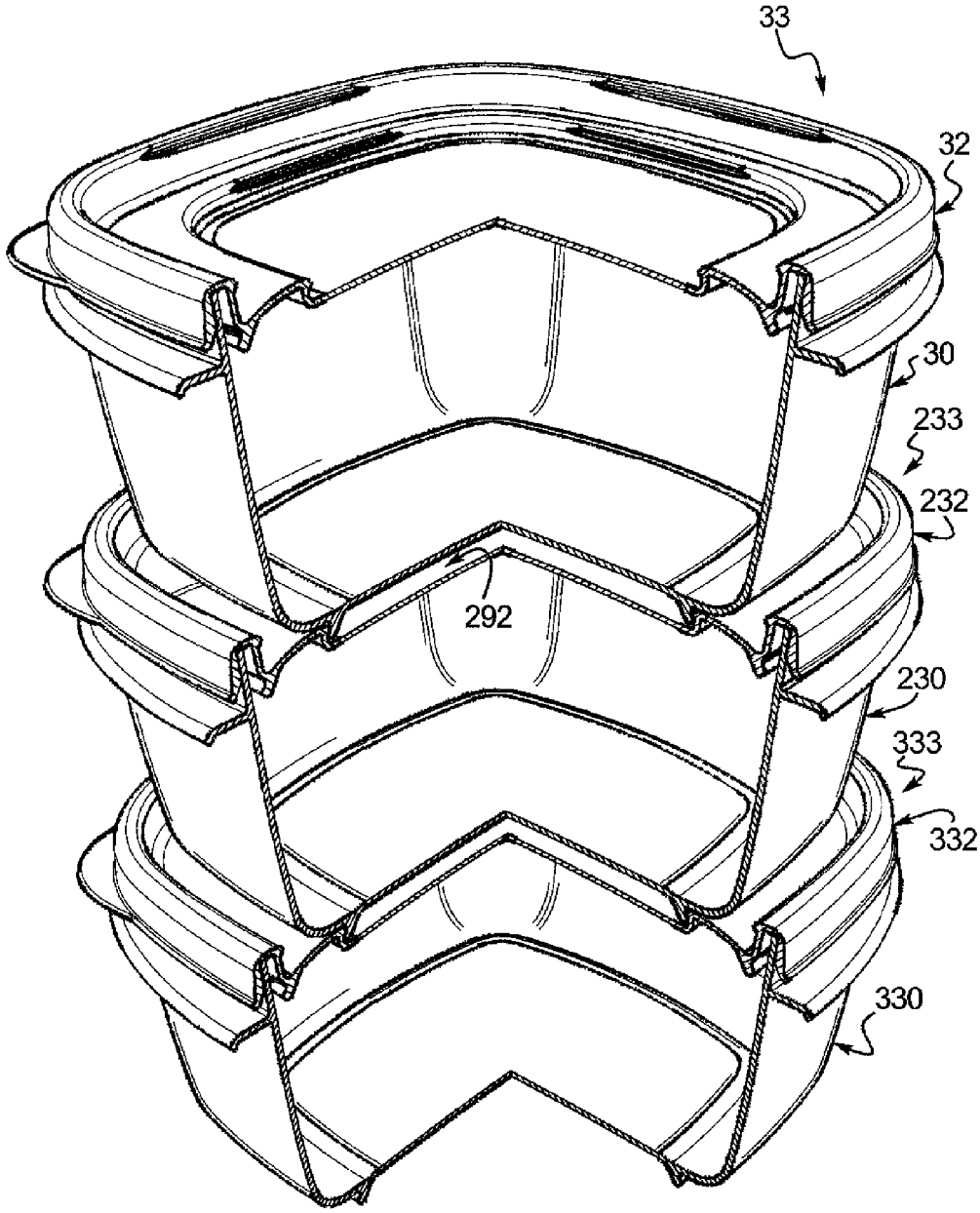
FIG. 8 shows a top perspective view of a one quarter cut-away section of three assembled containers as in FIG. 4B and stacked on top of one another.

As shown in FIG. 6B, when a lid 32 is snapped to a base bottom 36 the protrusions 96 on the lid 32 cooperate with and are received in corresponding ones of the channel 100 on the base. Also, the flanges 99 on the foot 98 of the base bottom 36 are simultaneously received in the undercuts 97 to provide a snap fit connection between base bottom and lid. More specifically, as best shown in FIG. 8, the flanges 99 and foot 98 on the base 30 are interferingly forced into the recessed region 92 on the top side 44 of the lid. The flanges 99 snap into the undercuts 97 and the protrusions on the lid snap into the channels 100 on the foot 98. The overlapping interference in the radial direction of the flanges 99 and the protrusions 96 holds the lid 32 attached to the base 30.

Figure 7:
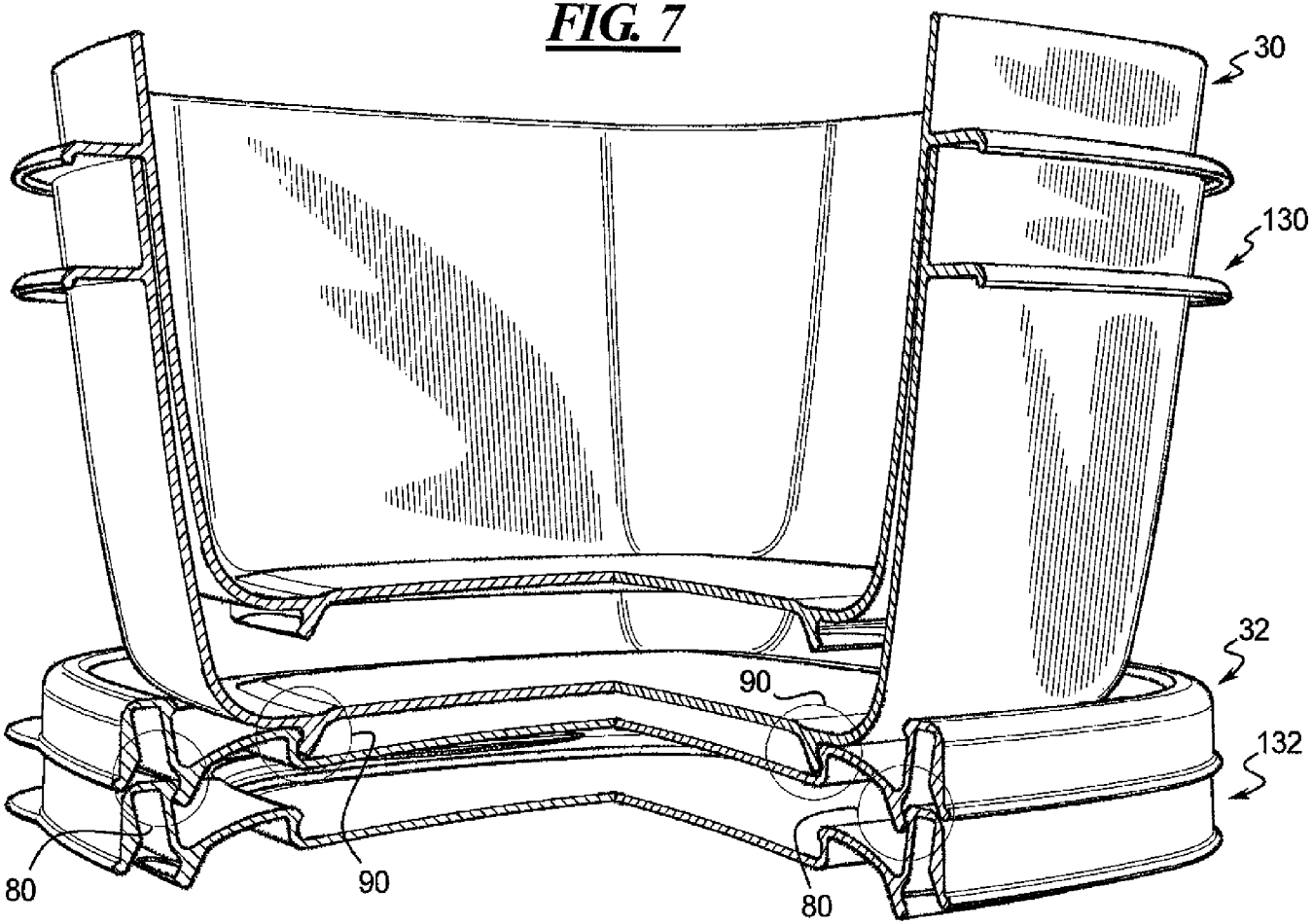
FIG. 7 shows a corner perspective view of a one quarter cut-away section of two bases as in FIG. 2 stacked together and two stacked lids as in FIG. 5 attached to the bottom of the base stack.

Multiple lids and bases can be used together in a variety of configurations. For example, as shown in FIG. 1, a lid can be coupled to the top of a single base for use as a sealed storage container. For example, the single container 24 includes the single base 24*a* and single lid 24*b*. Another configuration is shown in FIG. 7, in which multiple assembled containers 33, 233, and 333 are connected to form a stable stack of containers. The container 33 includes the base 30 and the lid 32. Likewise the container 233 includes the base 230 and the lid 232 and the container 333 includes the base 330 and the lid 332. The stack is formed by snapping the flanges 99 of the foot 98 of one base into the recessed region 292 of an adjacent lid 232 and so on. The stack in FIG. 7 may be formed of multiple containers of any combination of different sizes or multiple same sized containers as is shown. This construction allows a full container with its sealed lid to be snapped on top of the sealed lid of another full container. This facilitates transport of multiple, full containers stacked on top of one another without the containers on top sliding off those below.

In another example shown in FIG. 8, individual bases without lids can be nested to form a nested base stack for storage. For example, one base 30 can be nested within an identical same size base 130. The nested base stack can be formed of nested same-size bases or bases of different graduated or non-graduated sizes. Nesting smaller capacity bases within larger capacity bases provides for more efficient use of storage space, but the container bases can be stacked and nested as desired. The nested base stack can also be connected to one or more stacked lids 32 and 132 that are snapped onto the bottom of the lower-most base. For example, a stack of the lids 32 and 132 can be snapped together and snapped onto to bottom of the lowermost base 130 of the nested base stack.

In another example, the lids may be formed with a finger grip structure to facilitate removal of a lid secured to a base covering the open top. For example, a finger grip tab 110 can be formed to extend radially outwardly from the outer lower edge of the skirt assembly 50 on the container 33. The finger grip can be formed as a tab 110 only along a portion of the skirt assembly, such as on a corner of the square lids as shown herein, or can extend entirely around the skirt. In yet another example (not shown), a finger grip structure can be formed generally by extending a part of the skirt outer wall 56 generally radially outward.

In the example shown and described above, the container bases are of varying capacities with open tops that are identical in size and shape regardless of interior capacity. The lids are identical one-size-fits-all or universal lids. However, this invention can encompass a container system in which some different sized container bases have different sized open tops with lids sized only to fit a particular associated container base top opening size. However, the various lid-to-lid and lid-to-base snap structures can be formed to allow the different sized lids and/or bases to snap to any size lid or base. In another example, a system can be provided with several series of container base sizes. Each series can have bases with different capacities but the same size and shape top opening. Another series of that system can be provided with bases of different capacities and with top opening sizes and shapes that are common to one another but different from the other series.

Figure 9:
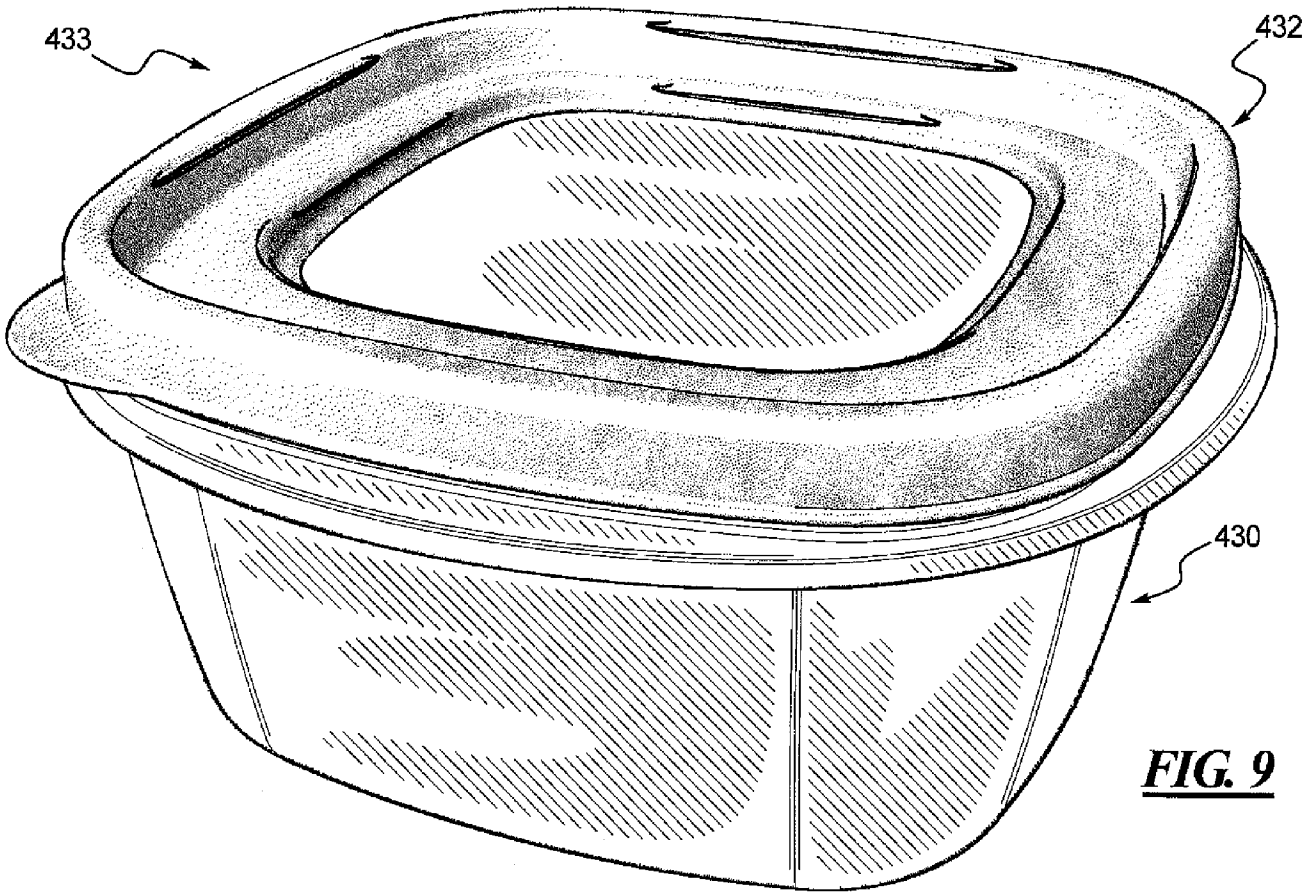
FIG. 9 shows an alternative embodiment of a container constructed in accordance with the teachings of the present invention.

The bases and lids can be formed from any suitable material and can be fabricated using any suitable process or method. In one example as shown in FIGS. 1-8, the lids can be a one-piece injection molded polypropylene or polyethylene and the bases can be injection molded polypropylene. In another example as shown in FIG. 9, a lid 432 of a container 433 can be dual molded from two (or more) different materials to achieve a number of different desired affects, such as improved functionality of the several snap and seal structures, aesthetic appearance, or the like. A portion of the lid 432 can be fabricated from opaque and/or colored material and a portion can be fabricated from a clear, transparent, or semi-transparent material. The two materials can have different textures, flexibility characteristics, surface friction characteristics, and the like.

A base 430 of the container 433 can also be dual molded from multiple different materials if desired, and for the same reasons. For example, the majority of the side wall and bottom can be formed from a substantially rigid, clear, transparent, or semi-transparent material. A portion of the base, such as the bottom foot or rib (described below) and/or parts of the rim or side wall can be formed from a different opaque and/or colored material to achieve improved seal and snap functionality and a desired aesthetic appearance. Alternatively, the base 430 as shown can be molded entirely of a single clear, transparent plastic material. Other materials can certainly be utilized to fabricate the bases and/or the lids as disclosed herein.

By providing lids and bases with mutually exclusive snap structures for lid-to-lid and lid-to-base attachments, the containers can be designed with greater variation in features. The components of one snap structure can be placed wherein desired on the base and lid parts without affecting the design of the other snap structure. The reverse is also true. Thus greater design flexibility can be achieved in the container products. Also, the disclosed container system permits greater variation in functionality during use. The lids and bases can be stacked, organized, and maintained in a greater number of different alternatives when stored during non-use than are permitted by prior art designs. During use, the containers can be stacked in a stable fashion to prevent spillage and can be stacked, carried, and transported during use much easier than prior known containers and systems.

Although certain storage containers and systems have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A storage container system comprising:

a plurality of container bases each having a bottom, a continuous side wall extending up from the bottom and terminating at a top edge, an interior storage space within the side wall above the bottom, and an open top bounded by the top edge;

a plurality of lids each having a main panel section, a perimeter skirt assembly around the main panel section, a top side, a bottom side, a recessed region centrally located on the main panel section, and a surrounding wall circumventing the recessed region, the recessed region being recessed relative to a top side of the perimeter skirt assembly, each of the plurality of lids configured to close off the open top of any one of the plurality of container bases by connecting a part of the perimeter skirt assembly to the side wall near the open top;

a first snap structure on each of the plurality of lids, each first snap structure having one component configured to connect to a mating lid component of the first snap structure on any other one of the plurality of lids to connect any two of the plurality of lids together; and a second snap structure different from the first snap structure on each of the plurality of lids, the second snap structure having one or more recesses in the surrounding wall each configured to snap to a mating base component on the base to connect any one of the plurality of lids to any one of the plurality of container bases.

2. A storage container system according to claim 1, wherein each of the plurality of container bases can nest at least partially within the interior storage space of the other container bases.

3. A storage container system according to claim 2, wherein at least two of the plurality of container bases are identical in size and shape to one another.

4. A storage container system according to claim 2, wherein relative storage capacities of the interior storage spaces of at least two of the plurality of container bases are different from one another.

5. A storage container system according to claim 1, wherein the perimeter skirt assembly of each of the plurality of lids has a channel formed within an inverted generally U-shaped annular structure having an inner wall extending up from the main panel section, a top wall, and an outer skirt wall depending from the top wall and spaced from the inner wall to form the channel, which is configured to receive the top edge of any one of the plurality of container bases to cover the open top and close off the interior storage space.

6. A storage container system according to claim 5, wherein one or more annular lips projects radially inward from a portion of the inner wall of the perimeter skirt assembly on the top side of each of the plurality of lids to form the one component of the first snap structure.

7. A storage container system according to claim 6, wherein the one or more annular lips are positioned generally on the inner wall adjacent the top wall of the perimeter skirt assembly.

8. A storage container system according to claim 6, wherein one or more annular ribs depend downward and radially outward from the bottom side of each of the plurality of lids to form the mating lid component of the first snap structure, the one or more annular ribs of each of the plurality of lids sized to snap and rest beneath the one or more annular lips of any other one of the plurality of lids.

9. A storage container system according to claim 1, wherein the one component of the first snap structure is on a part of the perimeter skirt assembly on the top side of each of the plurality of lids and the mating lid component is on the bottom side of each of the plurality of lids.

10. A storage container system according to claim 1, wherein the second snap structure is on the main panel section of each of the plurality of lids.

11. A storage container system according to claim 1, wherein each of the one or more recesses is formed radially inward into the surrounding wall.

12. A storage container system according to claim 11, wherein the mating base component on the bottom of each of the plurality of container bases includes one or more flanges extending radially outward and spaced from the bottom of the base, the one or more flanges sized to snap into the one or more recesses of any one of the plurality of lids.

13. A storage container system according to claim 1, wherein the mating base component on the bottom of each of the plurality of container bases includes one or more flanges extending in a radial direction and configured to snap into the second snap structure of any one of the plurality of lids.

14. A storage container system according to claim 1, wherein the one component of each of the first snap structures includes one or more lips extending radially inward on part of the top side of each lid, and wherein the mating lid component of each of the first snap structures includes one or more corresponding recesses facing radially outward on part of the bottom side of each lid, and wherein the one or more lips of one of the plurality of lids can snap into the one or more recesses of any other of the plurality of lids.

15. A storage container system according to claim 1, wherein the mating base component on each of the plurality of container bases includes one or more outwardly flared flanges extending from a foot that depends from the bottom of the base, the one or more flanges being configured to connect to the second snap structure on any one of the plurality of lids.

16. The storage container system according to claim 1, wherein a component of the first snap structure is positioned at or adjacent to an intersection of the perimeter skirt assembly and the main panel section.

17. A storage container comprising:

a base having a bottom, a continuous side wall extending up from the bottom and terminating at a top edge, an interior storage space within the side wall above the bottom, and an open top bounded by the top edge;

a base part of a lid-to-base snap structure on the bottom of the base, the base part comprising a foot that depends downward from the bottom of the base and one or more flanges that project radially outward from the bottom of the foot;

a lid having a main panel section, a perimeter skirt assembly around the main panel section, a top side, and a bottom side, the lid configured to close off the open top with the bottom side facing the interior storage space by connecting a part of the perimeter skirt assembly to the side wall near the open top; and a lid part of the lid-to-base snap structure on the top side of the lid configured to snap to the base part of the lid-to-base snap structure, the lid part comprising a recessed region in the top side of the lid, an annular wall spaced inward from the perimeter skirt assembly and surrounding the recessed region, and one or more recesses in the annular wall;

wherein the one or more flanges is sized to snap into the recessed region of the lid and to be received in the one or more recesses, and wherein the recessed region is recessed relative to a top side of the perimeter skirt assembly.

18. A storage container according to claim 17, further comprising:

a first component of a lid-to-lid snap structure on the top side of the lid; and a second component of the lid-to-lid snap structure on the bottom side of the lid, wherein the first and second components of the lid-to-lid snap structure are not part of the lid component of the lid-to-base snap structure, and wherein the lid-to-lid snap structure permits the lid to be snap connected to another lid with a like lid-to-lid snap structure.

19. A storage container according to claim 17, wherein the perimeter skirt assembly of the lid has an inverted generally U-shaped annular structure with an inner wall extending up from the main panel section, an outer skirt wall spaced radially outward from the inner wall, and a channel between the inner wall and outer skirt wall, the channel configured to receive the top edge of the side wall to cover the open top and close off the interior storage space.

20. A storage container according to claim 19, further comprising:

one or more lips of a lid-to-lid snap structure extending radially inward from the inner wall; and one or more recesses of the lid-to-lid snap structure facing radially outward on the bottom side of the lid, wherein the one or more lips and the one or more recesses are not part of the lid component of the lid-to-base snap structure, and wherein the lid-to-lid snap structure permits the lid to be snap connected to another lid with a like lid-to-lid snap structure.

21. A storage container according to claim 20, wherein the lid includes one or more ribs extending radially outward and downward from the bottom side that form the one or more recesses.

22. A storage container according to claim 20, wherein the lid is snapped onto a lid of another storage container wherein the lid of the other storage container also has a like lid-to-lid snap structure.

23. A storage container according to claim 20, wherein the lid is snapped to a stack of lids of other storage containers wherein the lids of the other storage containers also have like lid-to-lid snap structures.

24. A storage container according to claim 17, wherein the lid is snapped onto the bottom of the base by connection of the lid component to the base component of the lid-to-base snap structure.

25. A storage container according to claim 17, wherein the lid is installed covering the top opening of the base and wherein the lid component of the lid-to-base snap structure is snapped to a base component of a lid-to-base snap connector on a base of another generally like storage container.

26. A storage container according to claim 17, wherein the lid-part of the lid-to-base snap structure further comprises one or more protrusions that extend radially inward from the annular wall, wherein the base-part of the lid-to-base snap structure further comprises a radially outward facing channel formed between each of the one or more flanges and the bottom of the base.

27. A storage container according to claim 26, wherein the one or more protrusions are each configured to snap into the channel in order to snap the base part of the lid-to-base snap structure to the lid part of the lid-to-base snap structure.

28. A storage container system comprising:

a plurality of container bases each having a bottom, a continuous side wall extending up from the bottom and terminating at a top edge, an interior storage space within the side wall above the bottom, and an open top bounded by the top edge;

a plurality of lids each having a main panel section, a perimeter skirt assembly around the main panel section, a top side, a bottom side, a recessed region centrally located on the main panel section, and a surrounding wall circumventing the recessed region, each of the plurality of lids configured to close off the open top of any one of the plurality of container bases by connecting a part of the perimeter skirt assembly to the side wall near the open top;

a first snap structure on each of the plurality of lids, each first snap structure having one component configured to connect to a mating lid component of the first snap structure on any other one of the plurality of lids to connect any two of the plurality of lids together; and a second snap structure different from the first snap structure on each of the plurality of lids, the second snap structure having a first component of the second snap structure on each of the plurality of lids and a second component of the second snap structure on the bottom of each of the plurality of container bases, the first component of the second snap structure having a plurality of protrusions extending radially inward of the surrounding wall and a plurality of recesses formed radially inward into the surrounding wall below a respective protrusion of the plurality of protrusions, and the second component of the second snap structure having a foot that depends downward from the bottom of each container base, a plurality of flanges that project radially outward from the bottom of the foot, and a radially outward facing channel formed between each of the plurality of flanges and the bottom of the base, wherein the plurality of protrusions are each configured to snap into the channel and the plurality of flanges are sized to snap into a respective one of the plurality of recesses in order to snap the first component of the second snap structure to the second component of the second snap structure, and wherein the recessed region is recessed relative to a top side of the perimeter skirt assembly.

* * * * *